US006847156B2

(12) United States Patent
Kim

(10) Patent No.: US 6,847,156 B2
(45) Date of Patent: Jan. 25, 2005

(54) PLASMA DISPLAY DEVICE WITH HEAT RADIATING PLATE

(75) Inventor: Soon Hak Kim, Kyounsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/141,936

(22) Filed: May 10, 2002

(65) Prior Publication Data

US 2002/0195937 A1 Dec. 26, 2002

(30) Foreign Application Priority Data

May 11, 2001 (KR) ..... 2001-25876

(51) Int. Cl.[7] ..... H01J 1/02
(52) U.S. Cl. ..... 313/46; 313/493; 362/373
(58) Field of Search ..... 362/294, 373; 313/46, 493, 573, 582, 634; 165/905; 428/200

(56) References Cited

U.S. PATENT DOCUMENTS 5,528,474 A * 6/1996 Roney et al. ..... 362/545
5,804,102 A * 9/1998 Oi et al. ..... 252/587
5,834,337 A * 11/1998 Unger et al. ..... 438/122
6,090,473 A * 7/2000 Yoshikawa et al. ..... 428/209
6,346,334 B1 * 2/2002 Kamitani ..... 428/521
6,517,744 B1 * 2/2003 Hara et al. ..... 252/506

FOREIGN PATENT DOCUMENTS

JP 07183434 A * 7/1995 ..... H01L/23/373

* cited by examiner

*Primary Examiner*—Vip Patel
*Assistant Examiner*—Anthony Perry
(74) *Attorney, Agent, or Firm*—Fleshner & Kim, LLP

(57) ABSTRACT

A plasma display device that is adaptive for absorbing an external impact and reducing its weight. In the device, a heat-radiating plate is made from a polymer complex material that is a mixture of a resin with a metal material.

5 Claims, 3 Drawing Sheets

PLASMA DISPLAY DEVICE WITH HEAT RADIATING PLATE

BACKGROUND OF THE INVENTION

1. Field of the Invention

This invention relates to a plasma display device, and more particularly to a plasma display device that is adaptive for absorbing an external impact as well as reducing its weight.

2. Description of the Related Art

Generally, a plasma display panel (PDP) is a display device utilizing a visible light emitted from a phosphor layer when an ultraviolet ray generated by a gas discharge excites the phosphor layer. The PDP has an advantage in that it has a thinner thickness and a lighter weight in comparison to the existent cathode ray tube (CRT) and is capable of realizing a high resolution and a large-scale screen. The PDP includes a plurality of discharge cells arranged in a matrix pattern, each of which makes one pixel of a field.

FIG. 1 is a perspective view showing a discharge cell structure of a conventional three-electrode, alternating current (AC) surface-discharge PDP.

Referring to FIG. 1, a discharge cell of the conventional three-electrode, AC surface-discharge PDP includes a first electrode 12Y and a second electrode 12Z provided on an upper substrate 10, and an address electrode 20X provided on a lower substrate 18.

Each of the first electrode 12Y and the second electrode 12Z is a transparent electrode made from indium-tin-oxide (ITO). Since the ITO has a high resistance value, the rear sides of the first and second electrodes 12Y and 12Z are provided with bus electrodes 13Y and 13Z made from a metal, respectively. The bus electrodes 13Y and 13Z supplies a driving signal from the exterior to the first and second electrodes 12Y and 12Z, thereby applying a uniform voltage to each discharge cell.

On the upper substrate 10 provided with the first electrode 12Y and the second electrode 12Z in parallel, an upper dielectric layer 14 and a protective layer 16 are disposed. Wall charges generated upon plasma discharge are accumulated into the upper dielectric layer 14. The protective layer 16 prevents a damage of the upper dielectric layer 14 caused by a sputtering during the plasma discharge and improves the emission efficiency of secondary electrons. This protective layer 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphor layer 26. The address electrode 20X is formed in a direction crossing the first electrode 12Y and the second electrode 12Z.

The barrier rib 24 is formed in parallel to the address electrode 20X to prevent an ultraviolet ray and a visible light generated by a discharge from being leaked to the adjacent discharge cells. The phosphor layer 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

As shown in FIG. 2 and FIG. 3, one side of the panel having a plurality of discharge cells as mentioned above arranged in a matrix type is provided with a heat-radiating plate 30 and a driving circuit board 32 sequentially. A sash 41 is provided to cover the side surface of the panel 40, the heat-radiating plate 30 and a driving circuit board 32.

The driving circuit board 32 is attached to the heat-radiating plate 30 to apply a desired driving signal to the panel 40. To this end, the driving circuit board 32 and the panel 40 is electrically connected to each other by mean of a flexible cable (or flexible printed circuit) as not shown. The sash 41 is provided to enclose the side surface of the panel 40, the heat-radiating plate 30 and the driving circuit board 32, thereby protecting the driving circuit board 32 from an external impact.

The heat-radiating plate 30 is attached to a non-display area of the panel 40 by means of a double-face adhesive tape 36. The heat-radiating plate 30 supports the panel 40 and radiates a heat generated upon driving of the panel 40. Further, the heat-radiating plate 30 plays a role to fix up the driving circuit board 32. To this end, the heat-radiating plate 30 is provided with a plurality of first holes 34*a*, each of which is passed through by a screw (not shown in FIG. 3) so as to fix the driving circuit board 32 to the heat-radiating plate 30. Further, each end of the heat-generating plate 30 is provided with a plurality of second holes 34*b*, each of which is passed through by a screw (not shown) so as to fix the heat-radiating plate 30 to the sash 41.

Such a conventional heat-radiating plate 30 is made from aluminum having a high thermal conductivity so that it can effectively radiate a heat generated from the panel 40. However, since a metal of aluminum material fails to absorb or alleviate an impact, it transfers an external impact to the panel as it is. Accordingly, the panel 40 is liable to be damaged by an external impact.

Moreover, the aluminum metal has a heavy weight to cause an increase in total weight of the PDP. Particularly, since a size of the heat-radiating plate 30 is more enlarged as the PDP has larger dimension, a weight of the PDP is more increased. If the PDP has an increased weight, then it has a limit in its installation place. For instance, the PDP is installed at a wall or a ceiling, etc. However, if the weight of the PDP is increased, then the PDP installed at a wall or ceiling may depart from the wall or ceiling to be damaged. Particularly, when the wall or ceiling is made of a material having a weak strength such as wood, the PDP having a heavy weight is liable to depart from the wall or ceiling.

SUMMARY OF THE INVENTION

Accordingly, it is an object of the present invention to provide a plasma display device that is adaptive for absorbing an external impact as well as reducing its weight.

In order to achieve these and other objects of the invention, a plasma display panel according to an embodiment of the present invention includes a heat-radiating plate made from a polymer complex material, which is a mixture of a resin with a metal material.

The resin is a thermal crosslinkable resin.

In the plasma display device, the thermal crosslinkable resin is selected from at least one of epoxy, polyurethane, polyester and phenol resin group.

The component of the thermal crosslinkable resin is 10% to 70% of the polymer complex material.

The metal material is at least one of gold, silver, platinum and copper and aluminum.

The metal material contains 70% aluminum, 27% resin and at least on of gold, silver, platinum and copper 3%.

The component of said at least one metal of gold, silver, platinum and copper is 3% of the polymer complex material.

The polymer complex material contains 0.5% gold, 1.5% silver, 0.5% platinum and 0.5% copper.

The polymer complex material has a thermal conductivity of 10W/m-K to 100W/m-K.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
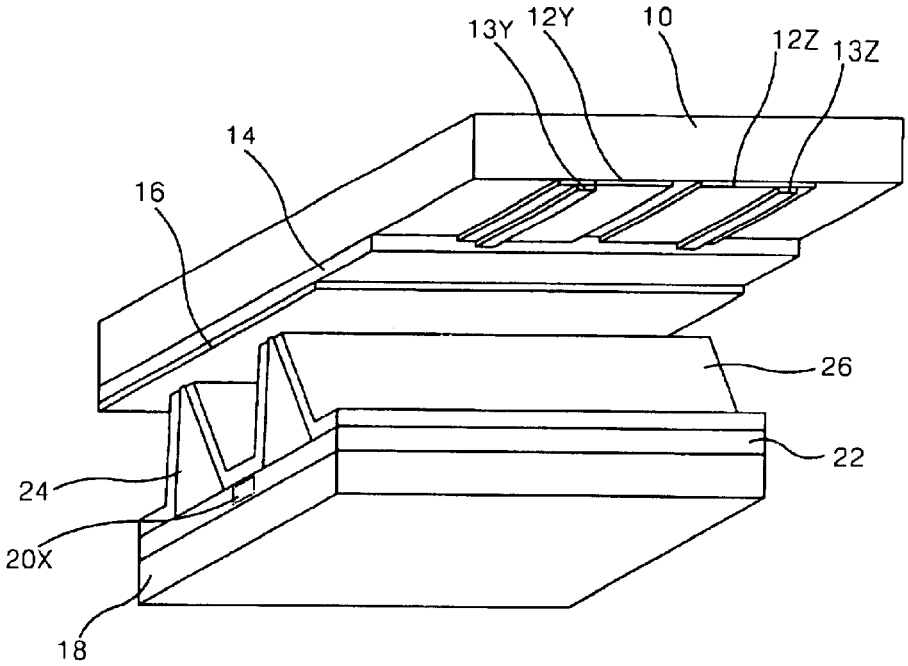
FIG. 1 CONVENTIONAL ART
FIG. 1 is a perspective view showing a discharge cell structure of a conventional AC surface-discharge plasma display panel.
Figure 2:
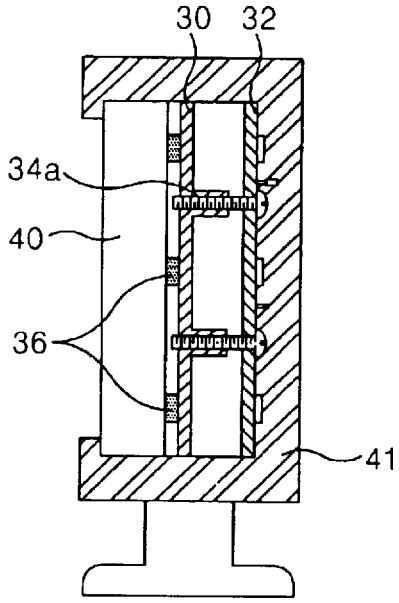
FIG.2 CONVENTIONAL ART
FIG. 2 is a section view showing a structure of a conventional plasma display device.
Figure 3:
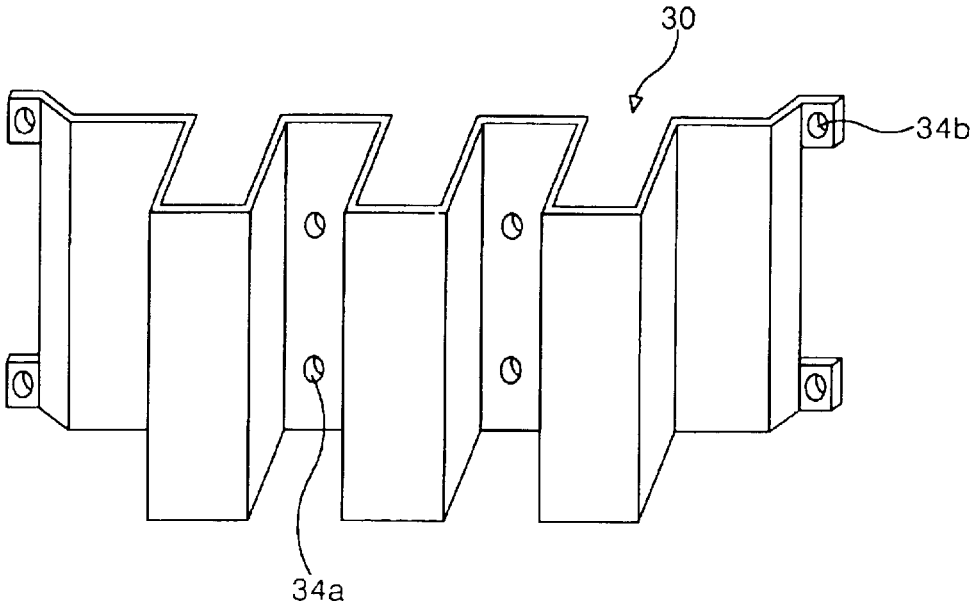
FIG.3 CONVENTIONAL ART
FIG. 3 is a perspective view showing a structure of a conventional heat-radiating plate.
Figure 4:
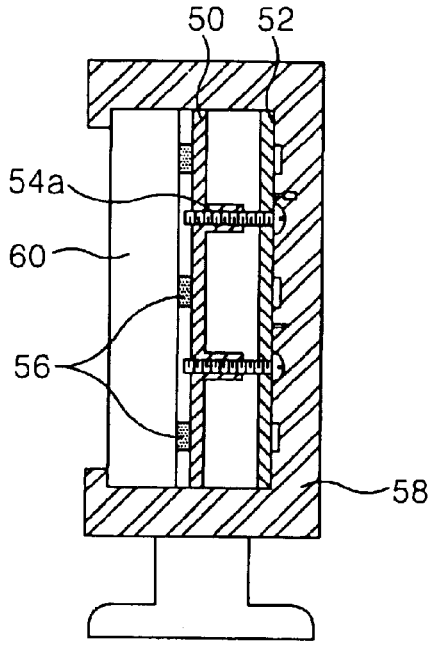
FIG. 4 is a section view showing a structure of a plasma display device according to an embodiment of the present invention.
Figure 5:
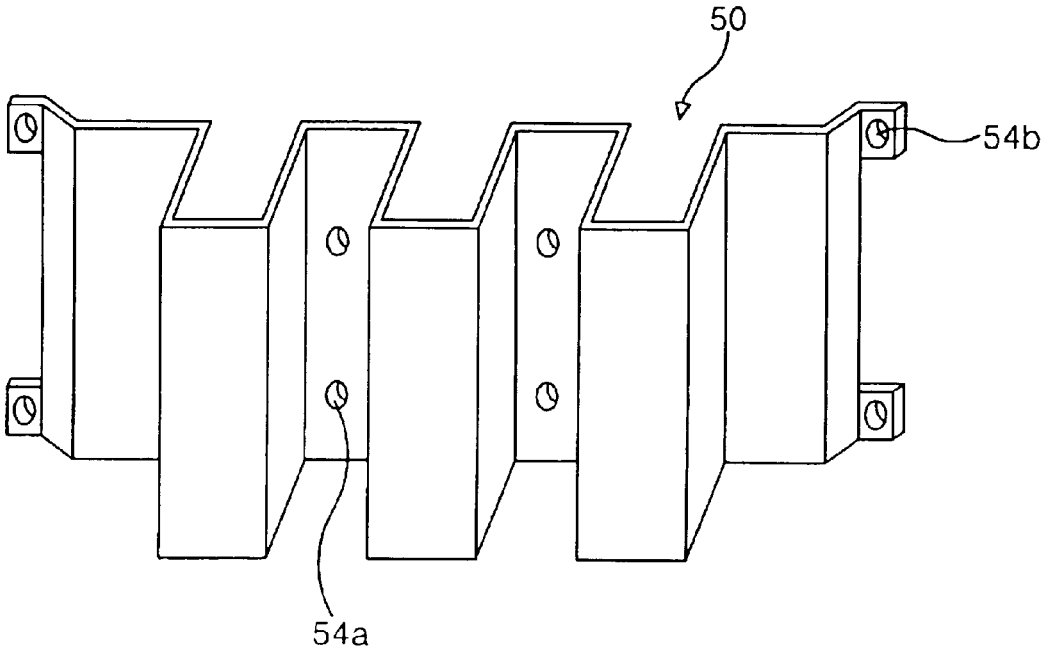
FIG. 5 is a perspective view of a heat-radiating plate according to the embodiment of the present invention.

FIG. 4 and FIG. 5 shows a plasma display device and a heat-radiating plate according to an embodiment of the present invention.

Referring to FIG. 4 and FIG. 5, the plasma display device includes a panel 60, a heat-radiating plate 50, a driving circuit board 52 and a sash 58.

The panel 60 has a plurality of discharge cells arranged in a matrix type. The heat-radiating plate 50 is attached onto a non-display area of the panel 60.

The driving circuit board 52 is attached to the heat-radiating plate 50 to apply a desired driving signal to the panel 40. To this end, the driving circuit board 52 and the panel 60 are electrically connected to each other by mean of a flexible cable (or flexible printed circuit). The sash 58 is provided to enclose the side surface of the panel 60, the heat-radiating plate 50 and the driving circuit board 52, thereby protecting the driving circuit board 52 from an external impact.

The heat-radiating plate 60 is attached to a non-display area of the panel 60 by means of a double-face adhesive tape 56. The heat-radiating plate 50 supports the panel 60 and radiates a heat generated upon driving of the panel 60. Further, the heat-radiating plate 50 plays a role to fix up the driving circuit board 52. To this end, the heat-radiating plate 50 is provided with a plurality of first holes 54*a*, each of which is passed through by a screw (not shown in FIG. 5) so as to fix the driving circuit board 52 to the heat-radiating plate 50. Further, each end of the heat-generating plate 50 is provided with a plurality of second holes 54*b*, each of which is passed through by a screw (not shown) so as to fix the heat-radiating plate 50 to the sash 58.

The heat-radiating plate 50 is made from a polymer complex material so that it has a light weight and can absorb an external impact. Herein, the polymer complex material is made from a mixture of a thermo crosslinkable resin, such as epoxy, polyurethane, polyester or phenol resin group, with aluminum (Al), gold (Au), silver (Ag), platinum(Pt) and copper (Cu) which are a good thermal conductivity.

Such a polymer complex material has a thermal conductivity of 10W/m-K to 100W/m-K.

A mixture ratio of the polymer complex material is established as indicated by the following table:

TABLE 1

| | Al % | Au, Ag, Cu, Pt % | Resin % | Thermal Conductivity | Weight Ratio |
|---|---|---|---|---|---|
| Comparative Material | 100 | | 0 | 100 W/m-K | 100 |
| Example 1 | 70 | 3 | 27 | 100 W/m-K | 75 |
| Example 2 | 57 | 3 | 40 | 82 W/m-K | 64 |
| Example 3 | 37 | 3 | 60 | 76 W/m-K | 43 |

Referring to Table 1, gold, silver, platinum and/or copper have a constant mixture ratio of 3%. Herein, the polymer complex material is a mixture of at least one of gold, silver and copper, and their mixed ratio is constantly kept at 3%. For example, if gold only is contained in the polymer complex material, a mixture ratio of gold is set to 3%. Alternatively, if gold, silver, platinum and copper are contained in the polymer complex material, each mixed ratio is set to silver 1.5%, gold 0.5%, platinum 0.5%, copper 0.5%.

The resin is contained in the polymer complex material such that it occupies 10% to 70% of the entire bulk. More specifically, if the resin of less than 9% is contained in the polymer complex material, a ratio of aluminum is increased to degrade a weight reduction effect. Also, if the resin of more than 71% is contained in the polymer complex material, its thermal conductivity is reduced. Accordingly, the resin is contained in the polymer complex material at a range of 10% to 70% in consideration of thermal conductivity and weight. At least one of epoxy, polyurethane, polyester and phenol resin group is used as the resin.

Meanwhile, it can be seen from the first example of the above Table 1 that, when the heat-radiating plate 50 is formed from a polymer complex material which contains aluminum of 70%, gold (silver, platinum and/or copper) of 3% and resin of 27%, its weight can be reduced to 75% of the prior art while having the same thermal conductivity as the conventional heat-radiating plate. Furthermore, as a ratio of the resin is more increased, a weight of the heat-radiating plate 50 can be more decreased. Herein, if a ratio of the resin is more than 28%, the thermal conductivity is slightly reduced. In addition, the heat-radiating plate 50 made from the polymer complex material absorb or alleviate an external impact. Accordingly, when an impact is applied from the exterior, it becomes possible to prevent a damage of the panel 60.

As described above, according to the present invention, the heat-radiating plate is made from the polymer complex material to reduce its weight. Accordingly, it becomes possible to prevent the plasma display device from departing from the wall due to the weight of the plasma display device. Furthermore, the heat-radiating plate made from the polymer complex material absorb or alleviate an external impact, so that it becomes possible to prevent a damage of the panel caused by an external impact. In addition, the polymer complex material allows a mass production through an injection molding, so that the manufacturing of the device is easy and the manufacturing cost can be reduced.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display device, comprising:

a plasma display panel; and a plate configured to radiate heat generated when the panel is driven, wherein said plate comprises a polymer complex material comprising 70% aluminum, 27% resin, and 3% of at least one of gold, silver, platinum or copper.

2. The plasma display device as claimed in claim 1, wherein the resin comprises a thermal crosslinkable resin.

3. The plasma display device as claimed in claim 2, wherein the thermal crosslinkable resin comprises at least one of epoxy, polyurethane, polyester or phenol resin group.

4. The plasma display device as claimed in claim 1, wherein the polymer complex material contains 0.5% gold, 1.5% silver, 0.5% platinum and 0.5% copper.

5. The plasma display device as claimed in claim 1, wherein the polymer complex material has a thermal conductivity of 10W/m-K to 100W/m-K.

* * * * *